US006536596B1

(12) United States Patent
Niitti et al.

(10) Patent No.: US 6,536,596 B1
(45) Date of Patent: Mar. 25, 2003

(54) FLOTATION CELL LINE

(75) Inventors: Timo Niitti, Ponte Vedra, FL (US); Matti Tarvainen, Espoo (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/786,994

(22) PCT Filed: Sep. 13, 1999

(86) PCT No.: PCT/FI99/00738

§ 371 (c)(1),
(2), (4) Date: Mar. 12, 2001

(87) PCT Pub. No.: WO00/15345

PCT Pub. Date: Mar. 23, 2000

(30) Foreign Application Priority Data

Sep. 15, 1998 (FI) ..... 981980

(51) Int. Cl.[7] ..... B03D 1/02; B03D 1/00; B03B 9/00

(52) U.S. Cl. ..... 209/168; 209/164

(58) Field of Search ..... 209/164, 168, 209/169, 170

(56) References Cited

U.S. PATENT DOCUMENTS 4,121,945 A 10/1978 Hurst et al.
4,477,338 A 10/1984 Hellmann
4,915,706 A * 4/1990 Daley

FOREIGN PATENT DOCUMENTS

DE 1 197 403 7/1965

* cited by examiner

*Primary Examiner*—Thomas M. Lithgow
(74) *Attorney, Agent, or Firm*—Smith-Hill and Bedell

(57) ABSTRACT

The invention relates to a flotation cell line, wherein there are installed, in order to treat the flotatable material, several flotation cells so that the flotatable material can be set to flow through the flotation cell line. According to the invention, the flotation cells (, 1, 2, 3, 4, 5; 31, 32, 33, 34, 35) that are arranged successively in the flowing direction (22, 52) of the flotatable material, are at least partly installed in parallel with respect to each other.

5 Claims, 2 Drawing Sheets

FLOTATION CELL LINE

Figure 1:
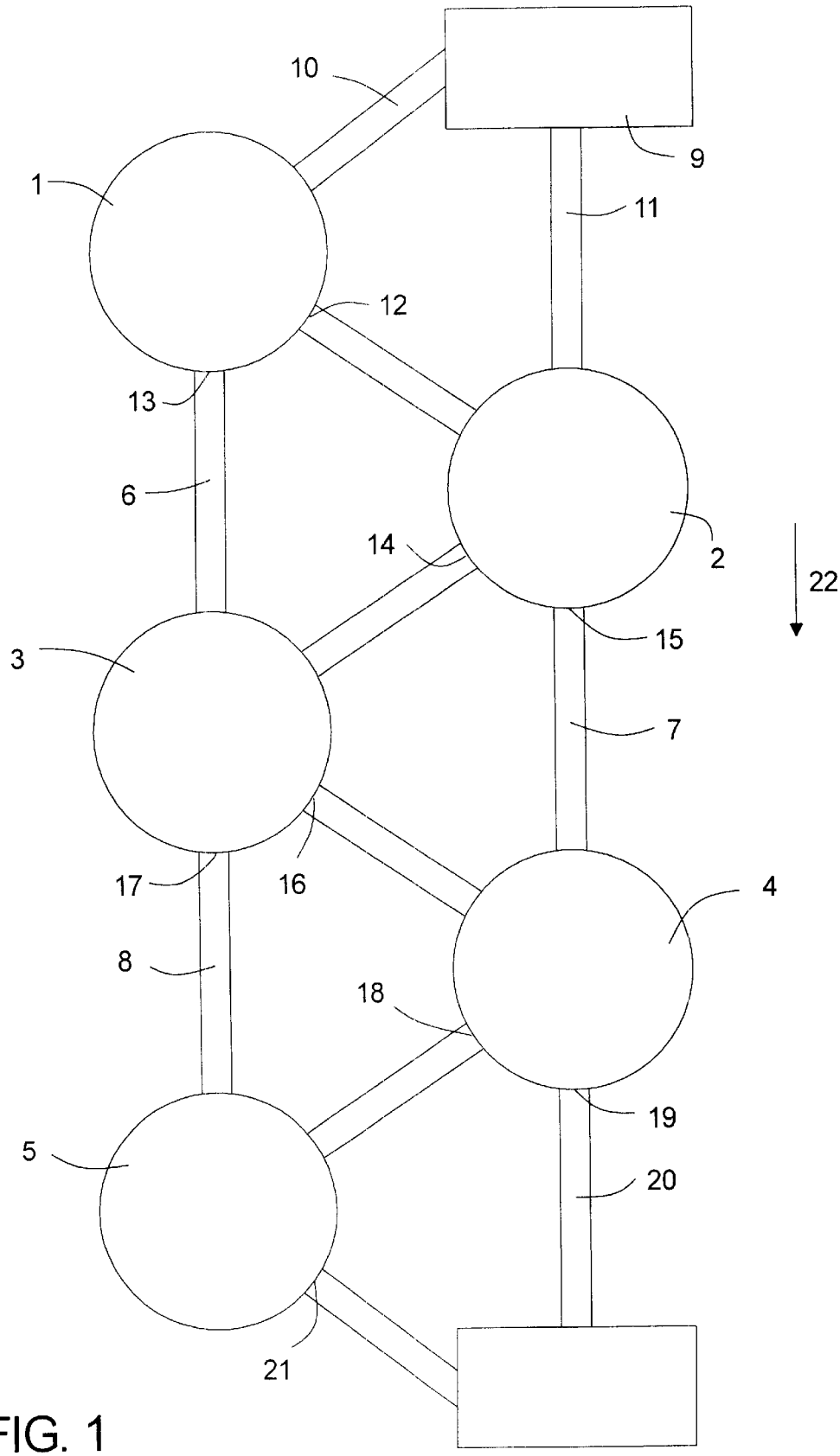

The present invention relates to a line formed by cells used in the treatment of flotatable materials, in which line the cells are installed with respect to each other, so that at least one cell can be withdrawn from the process without essentially deteriorating the operation of the flotation cell line.

In a flotation cell, there are treated slurry-like materials in order to remove from the rest of the material the desired ingredients that can be utilized. The main task of the flotation cell is to keep the flotatable material in suspension, to feed air into the suspension and to disperse the suspension into small air bubbles, as well as to conduct the utilizable ingredients, i.e. the concentrate, and the rest of the material, to separate locations. However, with respect to the recovered concentrate, the efficiency of the flotation cell is essentially low. Consequently, in order to achieve the desired degree of concentration for the utilizable ingredient, the flotation cells are usually coupled in series, so that the waste from the preceding flotation cell serves as the feed for the successive flotation cell. The concentrates obtained from the cells of the accordingly created flotation cell line are then combined and conducted to further treatment.

In a conventional flotation cell line, the cells are coupled in series with respect to each other, so that the whole flotation cell line must be stopped and production interrupted even in a case where only one cell in the flotation cell line needs repairs or maintenance. Because the capacity of the flotation cells as such has increased, and because respectively the number of parallel flotation cell lines has decreased, the relative capacity share of each flotation cell line becomes large. When this type of a flotation cell line must be stopped, for instance in order to maintain or repair one cell in the line, the procedure remarkably cuts the degree of utilization of the flotation process, and thus causes high extra expenses for the process.

The object of the present invention is to eliminate some of the drawbacks of the prior art and to achieve an improved flotation cell line, where the withdrawal of one flotation cell from the line does not cause any essential changes in the operation of the flotation cell line, and whereby it is possible to reduce the space needed for the flotation cell line. The essential novel features of the invention are apparent from the appended claims.

According to the invention, the flotation cell line is formed of flotation cells, which are provided with inlet and outlet apertures for the flotatable material, so that the flotatable material can be conducted from a flotation cell to at least two flotation cells that are located in succession to said flotation cell, when seen in the flowing direction of the flotatable material. Thus the flotatable material can be conducted alternatively either to the cell in the flotation cell line that is located next in the flowing direction of the flotatable material, or past the cell located next in the flowing direction, to at least one cell following in succession in the flowing direction of the flotatable material. In case the cell in question is the cell that is located last but one in the flowing direction of the flotatable material, the flotatable material can only be conducted to the last cell or to further treatment after the flotation cell line. Moreover, when feeding the flotatable material to the flotation cell line, the material can be fed either to the cell located first in the flowing direction of the flotatable material, or past the first cell to the cell located second in the flowing direction of the flotatable material.

When the flotatable material, according to the invention, is conducted past that cell in the flotation cell line that is located next in the flowing direction of the flotatable material, the flotatable material can in the flotation cell line be further conducted, irrespective of the flotation cell that is withdrawn from usage, so that the flotation cell line still can be used in the treatment of the flotatable material. Moreover, in a flotation cell line according to the invention, the flotation cells are installed at least partly in parallel, so that space can advantageously be saved in the flowing direction of the flotation cell line, and simultaneously the interval between two flotation cells is reduced, when the flotatable material is conducted past the cell that needs repairs or maintenance.

In the flotation cell line according to the invention, the cells are interconnected by means of conduits, so that in the outlet aperture of the cell, or in between the cells, there is installed a flow control member, which guides the flotatable material to the feed inlet of the cell that is located next in the flowing direction of the flotation cell line, or alternatively to the feed inlet of the cell that is located nearest to the next cell. Advantageously the number of inlet and outlet apertures of the cells provided in the flotation cell line is one or two. However, a larger number can also be applied, when desired. In the flotation cell line according to the invention, the number of the inlet and outlet apertures of individual flotation cells can alter, in which case different types of flotation cells can be combined in a flotation cell line.

According to the invention, when using both two inlet and two outlet apertures in the cells of the flotation cell line, the passage of the flotatable material either to the next cell or to the conduit passing the next cell is controlled already in the flotation cell itself, by keeping one outlet aperture and the inlet aperture provided in the receiving flotation cell open by means of the flow control members, so that the flotatable material flows from one cell to another.

The passage of the flotatable material from one flotation cell to the cell located next in the flotation cell line, or past the next cell, can also be arranged so that the flotatable material is discharged through the same outlet irrespective of the fact whether the flotatable material passes to the next flotation cell or to the conduit passing the next cell. Now the flow control member of the flotatable material is installed outside the flotation cell, in the conduit connecting the cells. When using only one outlet in the flotation cell, it is possible in the next receiving flotation cell to use either one or two inlets, because the flotatable material conduit meant for the passing of one flotation cell can be connected either to that conduit piece which provides for the flotatable material a direct contact between two successive flotation cells, or the conduit can be connected directly to the flotation cell as a separate inlet aperture.

In the flotation cell line according to the invention, the cells that are located successively in the flowing direction of the flotatable material are installed at least partly in parallel with respect to each other. Thus the distance of the first and last cell in the flotation cell line, when seen in the flowing direction of the flotatable material, is reduced, and the flotation cell line as such takes up less space than a conventional flotation cell line. Now also the distance between a cell and the cell located next in succession, when seen in the flowing direction of the flotatable material, is essentially reduced. Likewise, the conduit arranged between a cell and the cell located next in succession, when seen in the flowing direction, also is essentially short and easily installed in place. The distance proceeded by the flotatable material in the flotation cell line remains essentially the same as in a conventional flotation cell line, in case the flotatable material passes via all cells in the flotation cell line, but said distance is essentially shortened, in case the flotatable material is conducted past one or several flotation cells.

Figure 2:
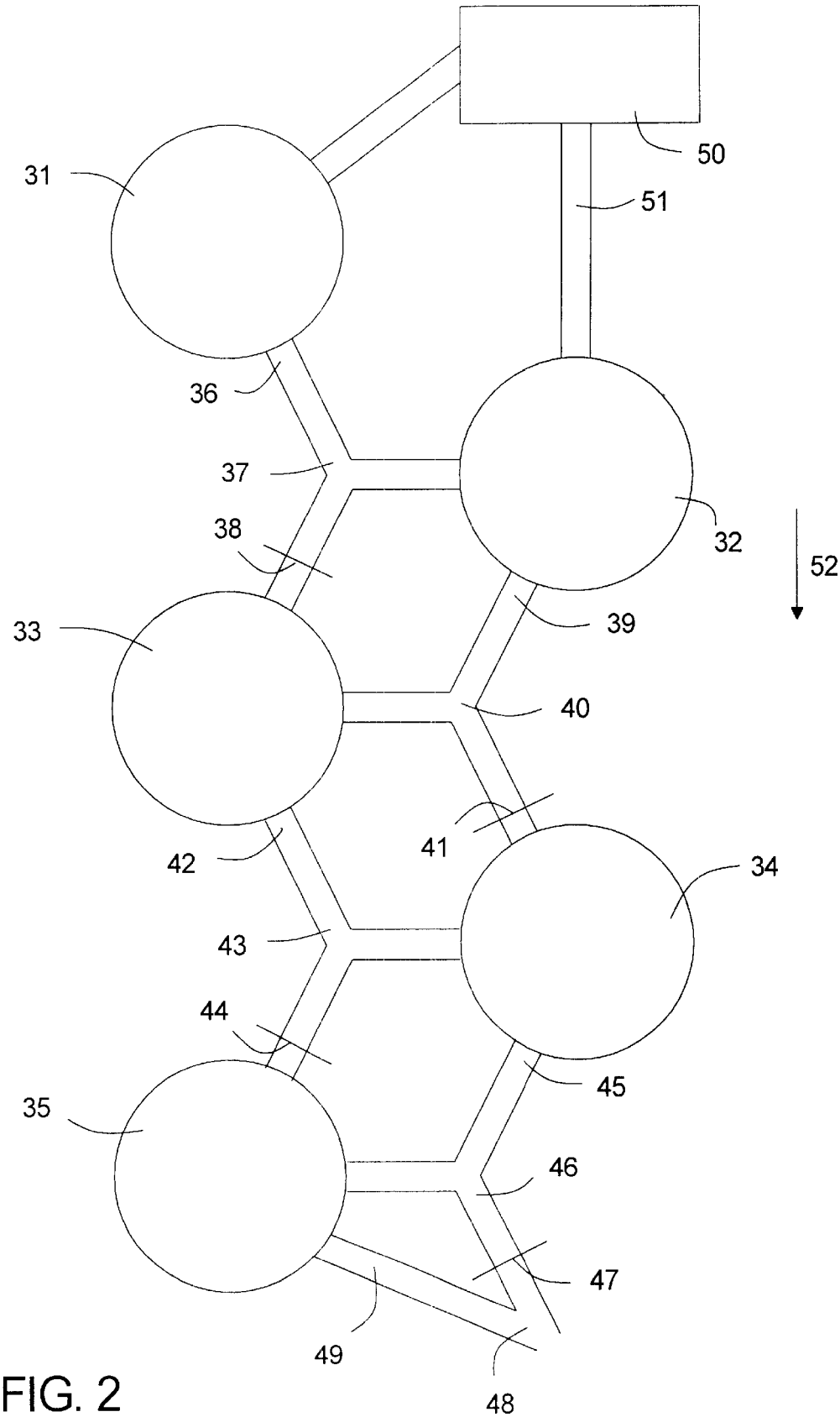

The invention is explained in more detail with respect to the appended drawings, where FIG. 1 is a schematical top-view illustration of a preferred embodiment of the invention, and FIG. 2 is a schematical top-view illustration of another preferred embodiment of the invention.

According to FIG. 1, the cells 1, 2, 3, 4 and 5 of the flotation cell line that are located in succession in the flowing direction 22 of the flotatable material, are installed partly in parallel with respect to each other, so that between the flotation cells 1 and 3, there is installed anduit 6, wherethrough the flotatable material can, when necessary, be conducted past the flotation cell 2. Respectively, a conduit 7 is installed in between the flotation cells 2 and 4 in order to conduct the flotatable material, when necessary, past the flotation cell 3. Moreover, there is illustrated a conduit 8 which is installed in between the flotation cells 3 and 5 in order to conduct the flotatable material past the flotation cell 4.

In the flotation cell line according to FIG. 1, the flotatable material is fed by means of a feeding device 9. The feeding device 9 is connected both to cell 1 and 2 by means of the conduits 10 and 11. In case the cell 1 is withdrawn from use, the flotatable material is fed directly to the cell 2 via the conduit 11. Normally the flotatable material fed into the flotation cell I is conducted in the flotation cell line via an outlet 12 to the flotation cell 2. In case the flotation cell 2 should be passed by, the flotatable material is conducted, via an outlet 13, to the conduit 6 and further to the flotation cell 3. In addition, the flotation cell 2 is provided with outlets 14 and 15 in order to conduct the flotatable material to the flotation cell 3, or past the flotation cell 3 via the conduit 7 to the flotation cell 4. Respectively, the flotation cell 3 is provided with outlets 16 and 17 in order to conduct the flotatable material either to the flotation cell 4 or via the conduit 8 directly to the flotation cell 5. The outlets 18 and 19 of the flotation cell 4 guide the flotatable material either to the flotation cell 5 or via the conduit 20 directly out of the flotation cell line and to further treatment. On the other hand, the flotation cell 5 includes only one outlet 21 in order to conduct the material, fed into the cell 5 and flotated therein, to the same material flow with the material that is possibly obtained from the conduit 20.

In the embodiment according to FIG. 2, the cells 31, 32, 33, 34 and 35 of the flotation cell line that are located in succession in the flowing direction 52 of the flotatable material are partly installed in parallel with respect to each other, so that the flotation cell 31 is connected to the next flotat ion cell 32 and to the flotation cell 33 successive to cell 32 by means of a conduit piece 37 connected to the outlet 36. The conduit piece 37 comprises a flow control member 38 for controlling the flotatable material flow, which guides the flow alternatively either to the flotation cell 32 or, when desired, to the flotation cell 33. Respectively, in the outlet 39 of the flotation cell 32, there is connected a conduit piece 40 provided with a flotatable material flow control member 41 for guiding the flow either to the flotation cell 33 or, when desired, to the flotation cell 34. Moreover, the conduit piece 43 connected to the outlet 42 of the flotation cell 33 is provided with a flotatable material flow control member 44 for guiding the flow either to the flotation cell 34 or, when desired, to the flotation cell 35. On the other hand, the flotatable material flow control member 47 provided in the conduit piece 46 connected to the outlet 45 of the flotation cell 34 guides the flow either to the flotation cell 35 or via the conduit 48 out of the flotation cell line. From the flotation cell 35, the material flotated in the flotation cell line is conducted, via the conduit 49, to one and the same material flow with the material possibly obtained from the conduit 48.

According to FIG. 2, the feeding of the flotatable material to the flotation cell line is carried out so that the material supplied from the feeding device 50 is conducted to the flotation cell 31, or the material can also be fed directly to the flotation cell 32 via the conduit 51.

What is claimed is:

1. A flotation cell line comprising at least first, second and third flotation cells each having an inlet means for receiving feed material to be processed in the flotation cell and an outlet means for discharging waste material from the flotation cell, wherein the inlet means and outlet means are connected so that in a first configuration of the flotation cell line waste material from the outlet means of the first flotation cell can be supplied as feed material to the inlet means of the second flotation cell and waste material from the outlet means of the second flotation cell can be supplied as feed material to the inlet means of the third flotation cell and in a second configuration of the flotation cell line the second flotation cell is by-passed and substantially all feed material supplied to the inlet means of the third flotation cell is waste material from the outlet means of the first flotation cell.

2. A flotation cell line according to claim 1, wherein the outlet means of the first flotation cell comprises first and second outlets and the flotation cell line comprises a first conduit connecting the first outlet of the first flotation cell to the second flotation cell, a second conduit connecting the second outlet of the first flotation cell to the third flotation cell, and a third conduit connecting the outlet means of the second flotation cell to the third flotation cell.

3. A flotation cell line according to claims 2, comprising flow control means for directing waste material from the first flotation cell selectively to the first conduit or the second conduit.

4. A flotation cell line according to claim 1, comprising a conduit structure including a first conduit connected to the outlet means of the first flotation cell, a second conduit connected to the inlet means of the second flotation cell, a third conduit connected to the inlet means of the third flotation cell, and a flow control member having a condition in which it allows material to flow directly from the first flotation cell to the third flotation cell.

5. A method of operating a flotation cell line comprising at least first, second and third flotation cells each having an inlet means for receiving feed material to be processed in the flotation cell and an outlet means for discharging waste material from the flotation cell, said method comprising, in a first mode of operation, connecting the inlet means and outlet means so that waste material discharged from the outlet means of the first flotation cell is supplied as feed material to the inlet means of the second flotation cell and waste material discharged from the outlet means of the second flotation cell is supplied as feed material to the inlet means of the third flotation cell, and, in a second mode of operation, connecting the inlet means and outlet means so that the second flotation cell is by-passed and substantially all feed material supplied to the inlet means of the third flotation cell is waste material discharged from the outlet means of the first flotation cell.

* * * * *